US008916761B2

(12) United States Patent
Robertson

(10) Patent No.: US 8,916,761 B2
(45) Date of Patent: Dec. 23, 2014

(54) AUDIO COUPLING DEVICE TO COUPLE AN ELECTRIC MUSICAL INSTRUMENT TO A HANDHELD COMPUTING DEVICE

(76) Inventor: Kevin Arthur Robertson, Mountain View, CA (US)

( * ) Notice: Subject to any disclaimer, the term of this patent is extended or adjusted under 35 U.S.C. 154(b) by 214 days.

(21) Appl. No.: 13/113,940

(22) Filed: May 23, 2011

(65) Prior Publication Data

US 2011/0219942 A1 Sep. 15, 2011

Related U.S. Application Data

(63) Continuation-in-part of application No. 12/565,334, filed on Sep. 23, 2009, now Pat. No. 8,772,620, and a continuation-in-part of application No. 13/039,243, filed on Mar. 2, 2011, now Pat. No. 8,816,182.

(60) Provisional application No. 61/143,786, filed on Jan. 10, 2009, provisional application No. 61/313,663, filed on Mar. 12, 2010.

(51) Int. Cl.
*G10H 1/00* (2006.01)
*G10H 3/18* (2006.01)

(52) U.S. Cl.
CPC ..... *G10H 3/186* (2013.01); *G10H 2230/015* (2013.01); *G10H 2240/121* (2013.01)
USPC ..... 84/600; 84/644; 84/670

(58) Field of Classification Search
None
See application file for complete search history.

(56) References Cited

U.S. PATENT DOCUMENTS

| | | | | |
|---|---|---|---|---|
| 5,689,677 | A | 11/1997 | MacMillan | |
| 5,739,455 | A * | 4/1998 | Poon | 84/615 |
| 5,789,689 | A | 8/1998 | Doidic et al. | |
| 5,977,474 | A | 11/1999 | O'Brien | |
| 6,222,110 | B1 | 4/2001 | Curtis et al. | |
| 6,242,682 | B1 * | 6/2001 | Marinic et al. | 84/626 |
| 7,129,872 | B1 | 10/2006 | Qvortrup et al. | |
| 7,174,891 | B2 * | 2/2007 | Lurie et al. | 128/204.23 |
| 7,579,958 | B2 * | 8/2009 | Wallace | 340/815.45 |
| 7,678,985 | B2 * | 3/2010 | Adams et al. | 84/645 |
| 7,754,956 | B2 | 7/2010 | Gain et al. | |
| 7,818,078 | B2 | 10/2010 | Iriarte | |
| 8,093,486 | B2 * | 1/2012 | Behringer et al. | 84/615 |
| 8,130,495 | B2 * | 3/2012 | Field et al. | 361/695 |
| 8,193,771 | B2 * | 6/2012 | Coccio | 320/132 |
| 8,721,441 | B1 * | 5/2014 | Chen et al. | 463/35 |
| 8,772,620 | B2 * | 7/2014 | Robertson | 84/735 |
| 8,816,182 | B2 * | 8/2014 | Robertson | 84/723 |
| 2004/0175993 | A1 | 9/2004 | Chennakeshu | |
| 2004/0247136 | A1 * | 12/2004 | Wallace | 381/56 |
| 2005/0092162 | A1 * | 5/2005 | Whitener et al. | 84/625 |
| 2005/0183566 | A1 | 8/2005 | Nash | |
| 2007/0133825 | A1 | 6/2007 | Waller, Jr. | |
| 2007/0137463 | A1 | 6/2007 | Lumsden | |
| 2007/0282467 | A1 * | 12/2007 | Rodrigues et al. | 700/83 |
| 2008/0167740 | A1 * | 7/2008 | Merrill | 700/94 |
| 2008/0298607 | A1 | 12/2008 | Wu et al. | |
| 2009/0182908 | A1 * | 7/2009 | Sherman et al. | 710/51 |
| 2009/0289635 | A1 * | 11/2009 | Coccio | 324/427 |
| 2010/0069114 | A1 | 3/2010 | Lee et al. | |
| 2010/0166237 | A1 * | 7/2010 | Leeper | 381/309 |

(Continued)

*Primary Examiner* — Marlon Fletcher
(74) *Attorney, Agent, or Firm* — Carr & Ferrell LLP

(57) ABSTRACT

An audio coupling device is disclosed that includes a connector for an electric musical instrument, a connector for a handheld computing device, and a connector for headphones. The device may also include electrical decoupling and shielding mechanisms.

20 Claims, 10 Drawing Sheets

(56) References Cited

U.S. PATENT DOCUMENTS

| | | | | |
|---|---|---|---|---|
| 2010/0175543 | A1* | 7/2010 | Robertson | 84/735 |
| 2010/0180756 | A1* | 7/2010 | Fliegler et al. | 84/723 |
| 2011/0116647 | A1* | 5/2011 | Terlizzi et al. | 381/71.6 |
| 2011/0129207 | A1 | 6/2011 | King et al. | |
| 2011/0146480 | A1* | 6/2011 | Robertson | 84/735 |
| 2011/0209598 | A1* | 9/2011 | Millar | 84/723 |
| 2011/0219942 | A1* | 9/2011 | Robertson | 84/735 |
| 2011/0283868 | A1* | 11/2011 | Behringer et al. | 84/622 |
| 2011/0311083 | A1* | 12/2011 | Bennett | 381/306 |
| 2012/0024129 | A1* | 2/2012 | Ball et al. | 84/602 |
| 2014/0169601 | A1* | 6/2014 | Pedersen | 381/316 |

* cited by examiner

AUDIO COUPLING DEVICE TO COUPLE AN ELECTRIC MUSICAL INSTRUMENT TO A HANDHELD COMPUTING DEVICE

CROSS-REFERENCE TO RELATED APPLICATIONS

This application is a continuation-in-part and claims the priority benefit of U.S. patent application Ser. No. 12/565,334, titled "Processing Audio Signals with Portable Handheld Computing Devices" and filed Sep. 23, 2009, now U.S. Pat. No. 8,772,620, issued Jul. 8, 2014, which claims the priority benefit of U.S. provisional application No. 61/143,786, titled "Guitar Amplifier and Audio Signal Processing Application for Portable Hand-Held Computing Devices" and filed Jan. 10, 2009. This application is also a continuation-in-part and claims the priority benefit of U.S. patent application Ser. No. 13/039,243, titled "Digital Audio Connections for Portable Handheld Computing Devices" and filed Mar. 2, 2011, now U.S. Pat. No. 8,816,182 issued Aug. 26, 2014, which claims the priority benefit of U.S. provisional application No. 61/313,663, titled "Digital Audio Connections for Portable Handheld Computing Devices" and filed Mar. 12, 2010, and is also a continuation-in-part and claims the priority benefit of U.S. patent application Ser. No. 12/565,334, titled "Processing Audio Signals with Portable Handheld Computing Devices" and filed Sep. 23, 2009, now U.S. Pat. No. 8,772,620 issued Jul. 8, 2014, which claims the priority benefit of U.S. provisional application No. 61/143,786, titled "Guitar Amplifier and Audio Signal Processing Application for Portable Hand-Held Computing Devices" and filed Jan. 10, 2009. Each of the disclosures listed above is incorporated by reference herein.

BACKGROUND

1. Field of the Invention

This invention generally relates to musical equipment, and more specifically to processing a signal from an electric guitar.

2. Description of Related Art

An electric guitar requires amplification and effects processing to achieve the desired output sounds. The electric guitar, an amplifier, and processing effects work together as a single instrument. For that reason, many musicians desire a portable battery powered practice guitar amplifier that is light-weight, inexpensive, and may be transported in a clothing pocket or small hand bag. Currently, portable battery powered practice guitar amplifiers typically have low sound quality with limited features. Alternatively, such amplifiers are very expensive due to the computing hardware and advanced battery technology that are required.

Portable handheld computing devices perform numerous entertainment and communication functions using high performance embedded computing hardware. The computing hardware required for these functions is significantly more expensive and more powerful than the hardware used by low cost battery powered practice guitar amplifiers that are currently available.

SUMMARY OF THE INVENTION

Various embodiments of the technology described herein provide a software application executable on a computing device that amplifies and processes electrical guitar signals. Specifically, the electric guitar amplification and audio effects processing may be executed on a portable battery powered handheld computing device. The term "electric guitar" as used herein refers to all musical instruments that use an electrical pickup to transmit sound to an amplifying device. The software program may utilize many of the capabilities of portable computing devices designed for handheld battery powered operation, including but not limited to audio signal input, audio signal output, loudspeaker, central processing unit, random access memory, non-volatile storage memory, computer operating system, visual display, input capability, and means for installing and removing software applications.

Exemplary embodiments of this technology may use the above listed capabilities to perform a user-selectable and adjustable combination of audio signal processing effects for an electric guitar. The effects may include volume control, vacuum-tube-like distortion, tone control equalization, tone shaping, cabinet simulation, reverb, digital delay, chorus, flanger, phase-shifter, rotating loud-speaker, tremolo, dynamics compression, hum canceller, and noise gate.

Further aspects of the software program may allow users to interact with digitally encoded music files stored in nonvolatile memory in handheld computing devices. The program may mix digitally encoded music files with the digitally processed guitar signal, thereby providing an enhanced experience for practicing guitar by playing along with pre-recorded songs. Additionally, the program may use digitally encoded music files as a simulated guitar input to the audio signal processing functions, for the purpose of demonstrating the signal processing capabilities of the software application.

In order to enable the coupling of the guitar to the handheld computing device, exemplary embodiments of a novel audio coupling device are also disclosed herein. The audio coupling device may couple an electric guitar and, if desired, headphones, to a handheld computing device. The audio coupling device may be configured to mechanically couple the guitar and the handheld computing device without any instrument or audio cable adaptors.

One of the advantages of the disclosed technology is its production of a high performance practice guitar amplifier software program for execution on battery powered handheld computing devices coupled to the guitar with a specially designed audio coupling cable.

Another advantage of the disclosed technology is the enhancement it provides to the practicing experience, by mixing the processed guitar signal with song titles stored in the non-volatile storage memory in the portable handheld computing device.

Yet another advantage of the disclosed technology is that it may provide demonstration capabilities using music files stored in non-volatile storage memory as simulated guitar input to the practice guitar amplifier software application.

These and other advantages and objects of the embodiments of the disclosed technology will become apparent to those skilled in the art in view of the description of the technology as described herein and as illustrated in the drawings.

DETAILED DESCRIPTION

The technology disclosed herein is a high performance software application for electric guitar amplification and audio effects processing. The application enhances the practicing experience by enabling amplification and signal processing using portable equipment. The application also enables the user to add optional effects to the guitar signal, and to mix the processed guitar signal with song titles stored in non-volatile storage memory in the portable handheld computing device. The application can also be demonstrated by using the stored song titles as simulated guitar input to the practice guitar amplifier software application.

The software application takes advantage of many of the capabilities of the host portable computing device. Host device capabilities utilized may include audio signal input, audio signal output, loudspeaker, a central processing unit, random access memory, non-volatile storage memory, computer operating system, visual display, input capability, and means for installing and removing software applications. It should be noted that due to certain limitations inherent in the handheld computing environment—relatively slow processing speeds, limited memory, and limited battery power—programming techniques not used for applications running in the typical PC/laptop environment must be utilized. Among these techniques are efficient audio sample block processing and fixed point mathematical computations.

The software application will typically be available via download from a server of an applications distributer. However, it should be noted that the software application can be stored and distributed via any computer-readable storage medium.

Figure 1:
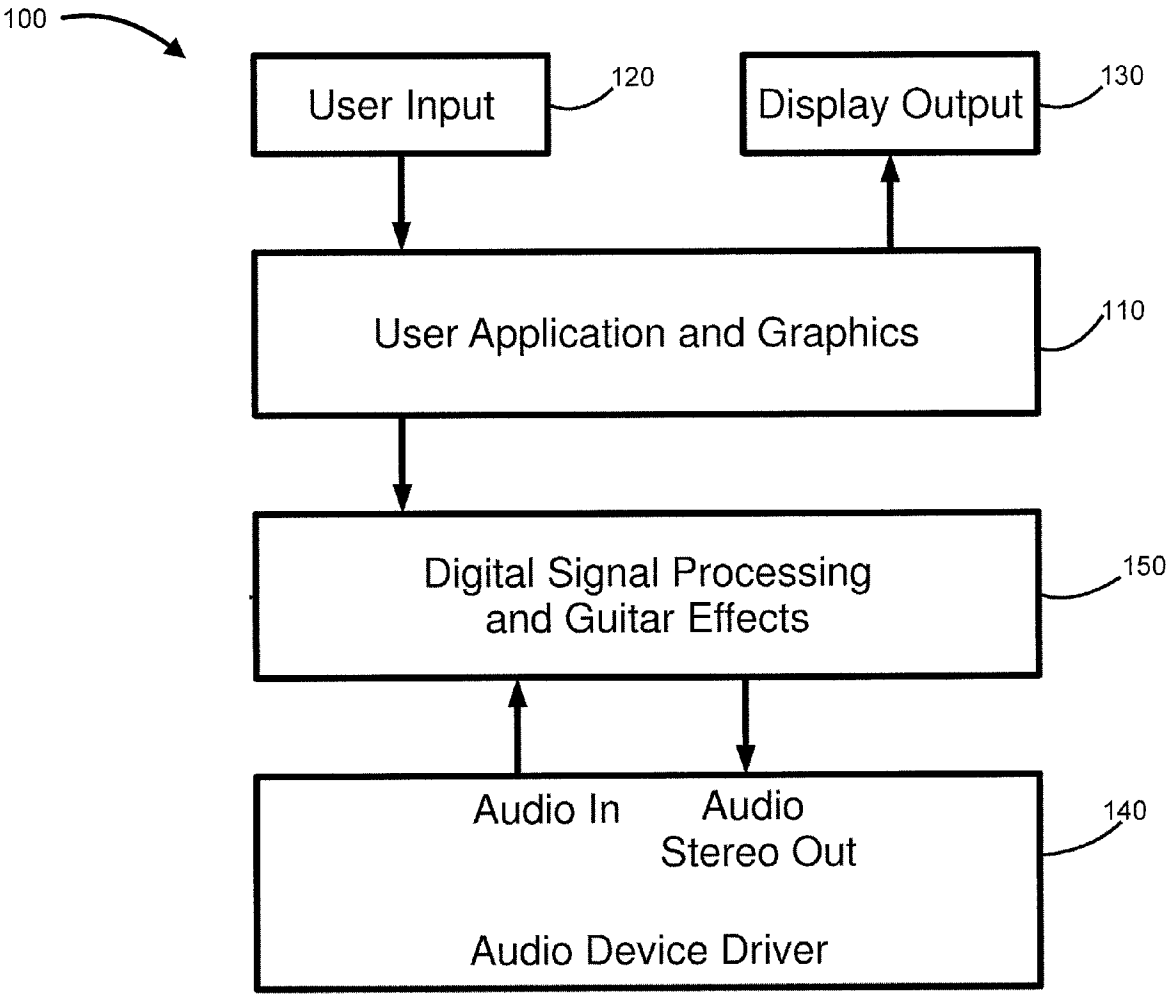
FIG. 1 is a block diagram of an exemplary embodiment of the controlling software for the guitar amplifier and audio signal processing application.

FIG. 1 shows one exemplary configuration of the software application 100 and software interfaces for the computing device that is utilized for electric guitar amplification and audio effects processing. The user application and graphics software 110 creates the look and feel of the practice guitar amplifier application. The user application and graphics software 110 displays the various selections and adjustments for the guitar signal processing effects that are available to the user. The user application and graphics software 110 interfaces with user input 120, and based on the selections input by the user, generates an appropriate display output 130.

The guitar amplifier software application may be supported by any type of platform of currently existing operating systems. The application interfaces, through user input 120, with the display output 130 of a host handheld computing device 510 (FIG. 5) to generate an appropriate visual display. In addition, the operating system platforms provide an audio device driver 140, which may be used to generate the audio output.

The signal received by the guitar amplifier software application 100 is processed in real time by the digital signal processing and guitar effects software block 150. The digital signal processing and guitar effects software block 150 adds those guitar effects selected by the user through the user input 120 and the user application and graphics software 110.

Figure 2:
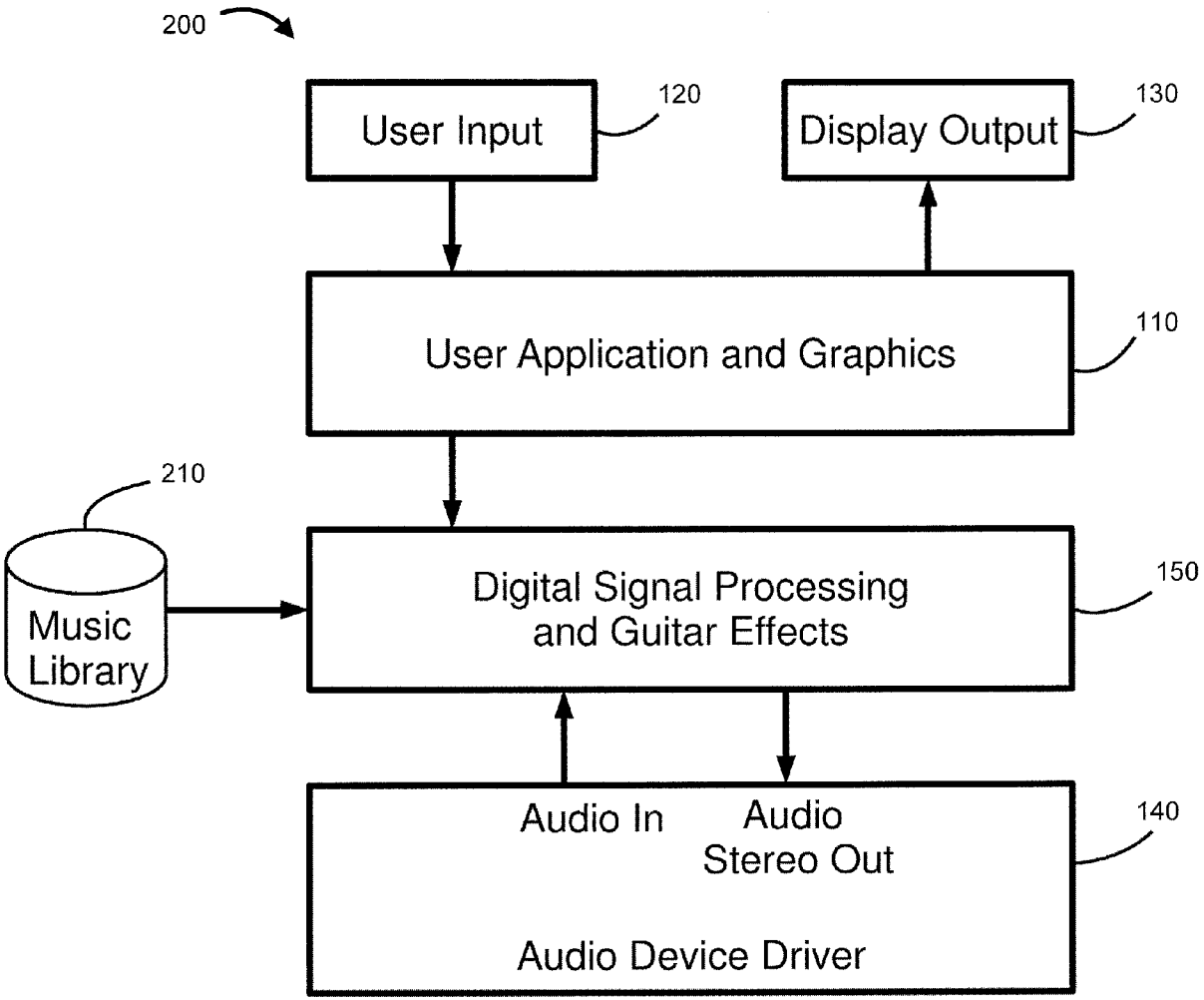
FIG. 2 is a block diagram of an exemplary embodiment of the controlling software for the guitar amplifier and audio signal processing application including a music library.
Figure 5:
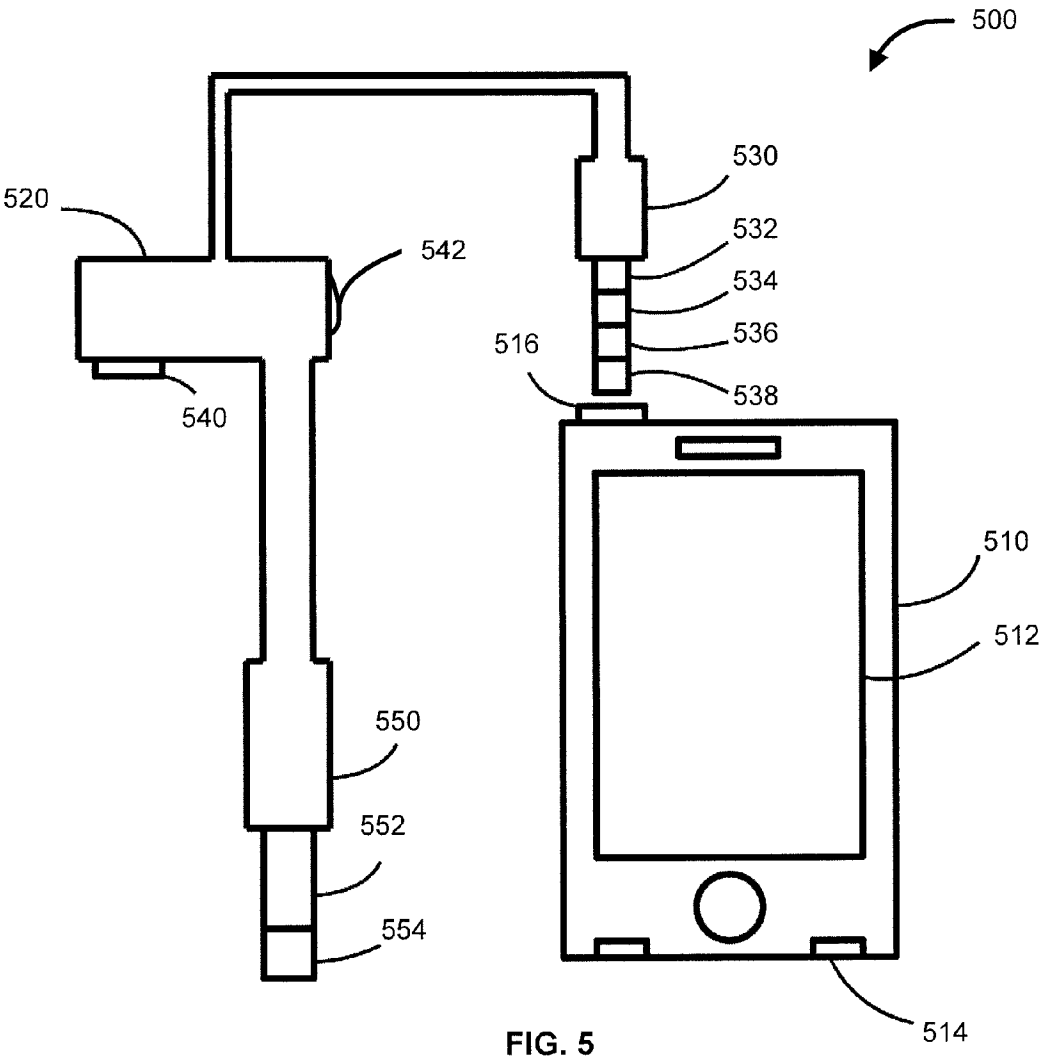
FIG. 5 illustrates a front view of an exemplary system for processing a signal from an electric guitar.

FIG. 2 illustrates an exemplary embodiment of the software application 200 that includes a music library 210. The music library 210 contains digitally encoded music files stored in the non-volatile storage memory of the handheld computing device 510 (FIG. 5). If the user so desires, background music from the music library 210 may be added to the guitar signal so that the user may play along with the pre-recorded background music.

After the input guitar signal is processed and mixed, the resultant signal (which is the combined signal output) may then be transmitted through the audio device driver 140 as the stereo sound output of the guitar. Thus, the digital signal processing and guitar effects software block 150 is in two-way communication with the audio device driver 140. The software block 150 receives the audio input signal that is generated by the guitar as input audio in, processes the guitar signal and adds effects and/or backup music, and finally transmits the resultant signal to the audio stereo output.

Figure 3:
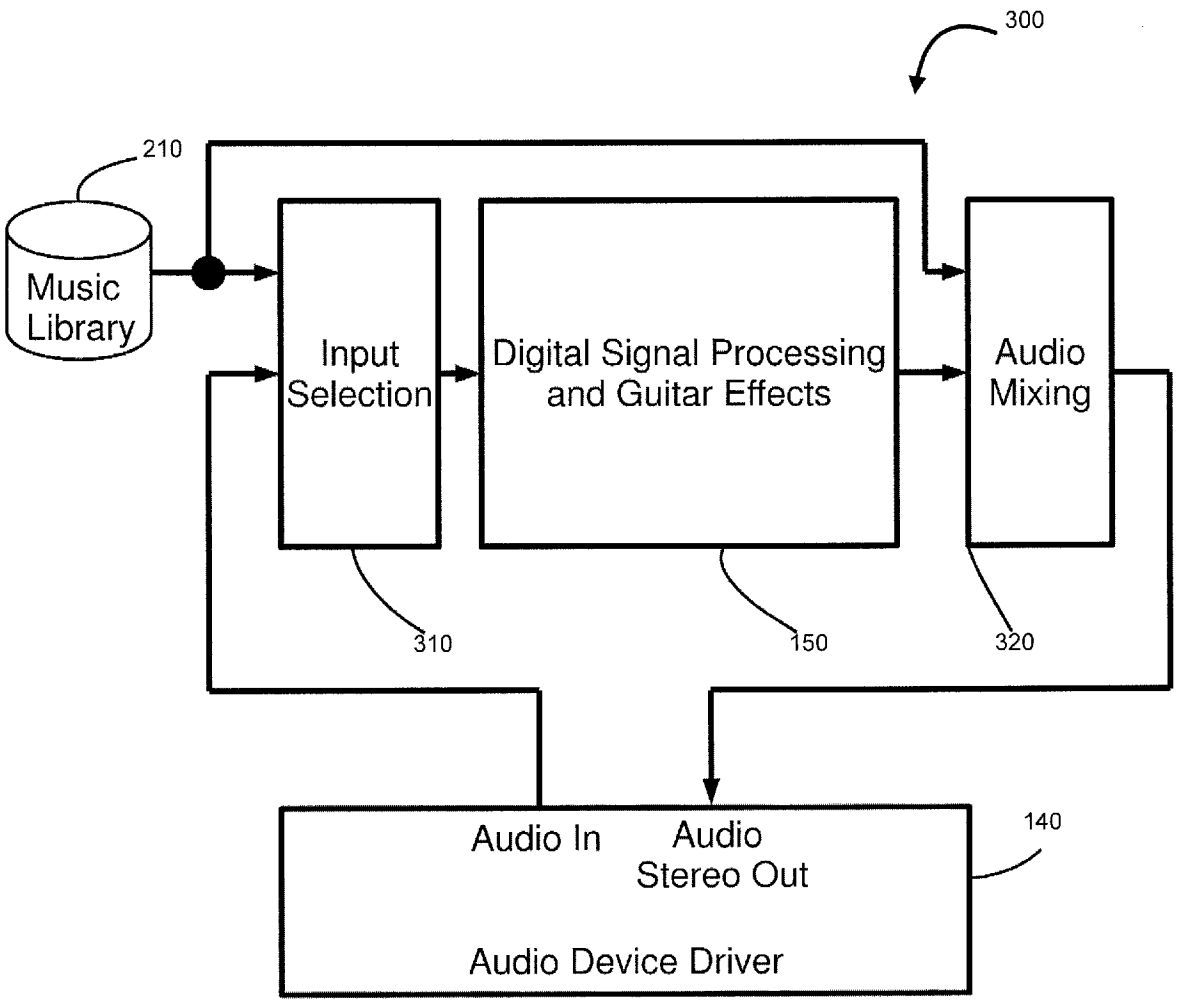
FIG. 3 is a software flowchart of an exemplary embodiment of the guitar amplifier including a depiction of the input selection and audio mixing functions.

FIG. 3 is a flow chart of the software application 300 depicting two different modes of operation for the digital signal processing and guitar effects software 150. During a normal practice session, the audio in (guitar input) from the audio device driver 140 is selected by the input selection block 310. The guitar signal is filtered in real-time by the digital signal processing and guitar effects software 150. The effects available from the processing and effects block 150 include at least volume control, vacuum-tube-like distortion, tone control equalization, tone shaping, cabinet simulation, reverb, digital delay, chorus, flanger, phase-shifter, rotating loud-speaker, tremolo, dynamics compression, hum canceller, noise gate, and any combination thereof.

The guitar signal output of the digital signal processing and guitar effects software 150 may be mixed in the audio mixing block 320 with pre-recorded music if the user has chosen a title from the music library 210. The resultant output signal of the audio mixing block 320 is then fed to the audio stereo out function of the audio device driver 140. The audio stereo out can then be accessed by the user either through the second female headphone jack 540 (FIG. 5) or through the speakers 514 (FIG. 5) of the handheld portable computing device 510 (FIG. 5).

As demonstrated by the exemplary configuration shown in FIG. 3, the capabilities of the guitar amplifier software application 300 can be displayed even without a guitar input signal. To utilize the demonstration capability, the user inputs his choice of title stored in the music library 210. The input selection block 310 uses that selection to input the selected demonstration recording from the music library 210 to the digital signal processing and guitar effects software 150. This process thereby provides a simulated guitar input to the digital signal processing and guitar effects software 150, so that an effective demonstration of the guitar amplifier application 300 is provided, even though no actual guitar input is available from the audio driver 140.

Figure 4:
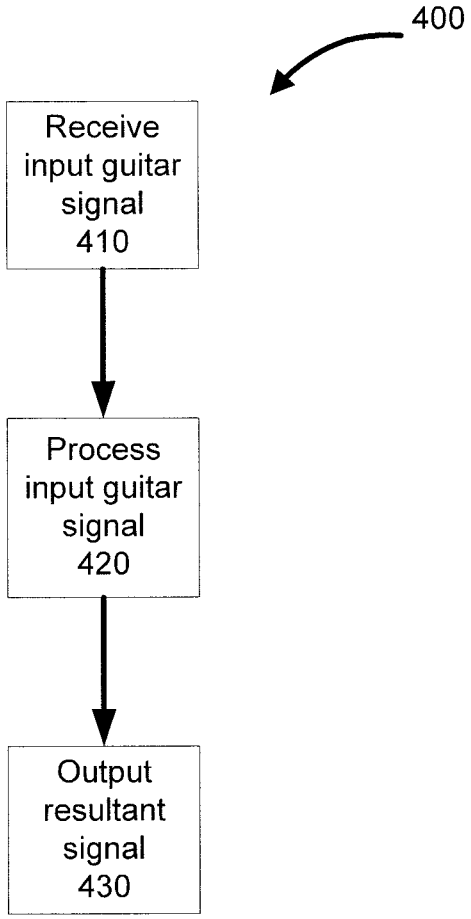
FIG. 4 is a flowchart illustrating an exemplary method of processing a signal from an electric guitar.

FIG. 4 is a flowchart illustrating a summary of an exemplary method 400 for processing an audio signal from an electric guitar. In initial step 410, an input guitar signal is received by a handheld computing device. In step 420, the input guitar signal is processed to add user-selectable audio effects, which results in a combined signal output. The user may add any of several stored effects, or pre-recorded music from the music library 210. The processed signal is then transmitted in step 430 as the combined signal output. The software to accomplish the method will typically be downloaded directly to the user's computing device. The software application can be stored and distributed on any computer-readable storage medium.

Referring now to FIG. 5, an exemplary system 500 for processing an audio signal of a musical instrument utilizes, among other components, a processor of a portable battery powered handheld computing device 510 and an audio coupling cable 520. It should also be noted that while the audio coupling device is characterized herein as a cable, the device could also be constructed as a rigid element, a box or the like.

The representative handheld computing device 510 includes at least an input device 512 (typically a touch control display) that controls the functions of the computing device 510, at least one speaker 514 for audio output, a processor, and a female stereo headphone jack 516.

Significant challenges exist for executing an embodiment of the guitar amplifier software on a typical handheld computing device. The typical handheld device is constructed to support physical audio connections designed only for music playback and telephony. It is therefore not possible to mechanically connect an electric guitar and headphones to a handheld computing device without one or more audio connection adapters.

To eliminate the physical connection problem, the exemplary embodiment 500 utilizes an audio coupling cable 520 comprising a male stereo plug 530 with four electrical contact areas: a microphone signal contact 532, a ground signal contact 534, a right stereo signal contact 536, and a left stereo signal contact 538. The stereo plug 530 provides the input means for the guitar signal that is received by the handheld computing device 510.

Since the male stereo plug 530 will typically occupy the only headphone connection provided on the handheld computing device 510, the audio coupling cable 520 further comprises a second female stereo headphone jack 540 in order to provide the user of the device with headphone capability. The second female stereo headphone jack 540 includes a three contact output connection for the ground signal, the left stereo signal, and the right stereo signal.

The audio coupling cable 520 further comprises a male mono plug 550 to provide a connection to the guitar (not illustrated). The male mono plug 550 includes contact areas for the ground signal 552 and the guitar signal 554.

An input level control 542 may be included as a component of the audio coupling cable 520. The input level control function is sometimes also referred to as "trim".

In an exemplary mode of operation, the female stereo headphone jack 516 receives the male stereo plug 530. The male mono plug 550 is received in the electric guitar instrument output jack. If the user chooses to not use the speakers 514 of the handheld computing device 510, the user can simply plug standard headphones into the second female stereo headphone jack 540.

As will be readily apparent to those skilled in the art, there are multiple variations readily available for the hardware connections of the disclosed technology. For example, the mono male plug 550 with contacts for signals 552 and 554 could be readily replaced with a mono female jack. The mono female jack would allow the electric guitar connection to be made using a common guitar instrument cable. Similarly, the stereo male plug 530 with contacts 532, 534, 536, and 538 could be replaced with a stereo female jack, which would allow a connection to the female stereo headphone jack 516 with a common stereo audio cable. The stereo male plug 530 with contacts 532, 534, 536, and 538 could also be utilized with a multifunction connection cable that includes an audio line input. Examples of handheld computing devices 510 that use this type of multifunction connection cable are the iPhone® and iPod Touch® that utilize a dock connector. It should be recognized that with respect to these variations, an instrument cable and an audio cable are not considered adapters by those skilled in the art.

It will also be recognized to those skilled in the art that although the audio coupling cable 520 has been described with reference to an electric guitar, the coupling cable 520 could be used with any electric musical instrument that the user wants to connect to a computing device.

Another straightforward modification to the audio coupling cable 520 can be employed if it is presumed that the user will choose to always use a set of headphones. In that case, the stereo female jack 540 can be eliminated by hardwiring a pair of standard stereo headphones to the audio coupling cable 520.

Figure 6:
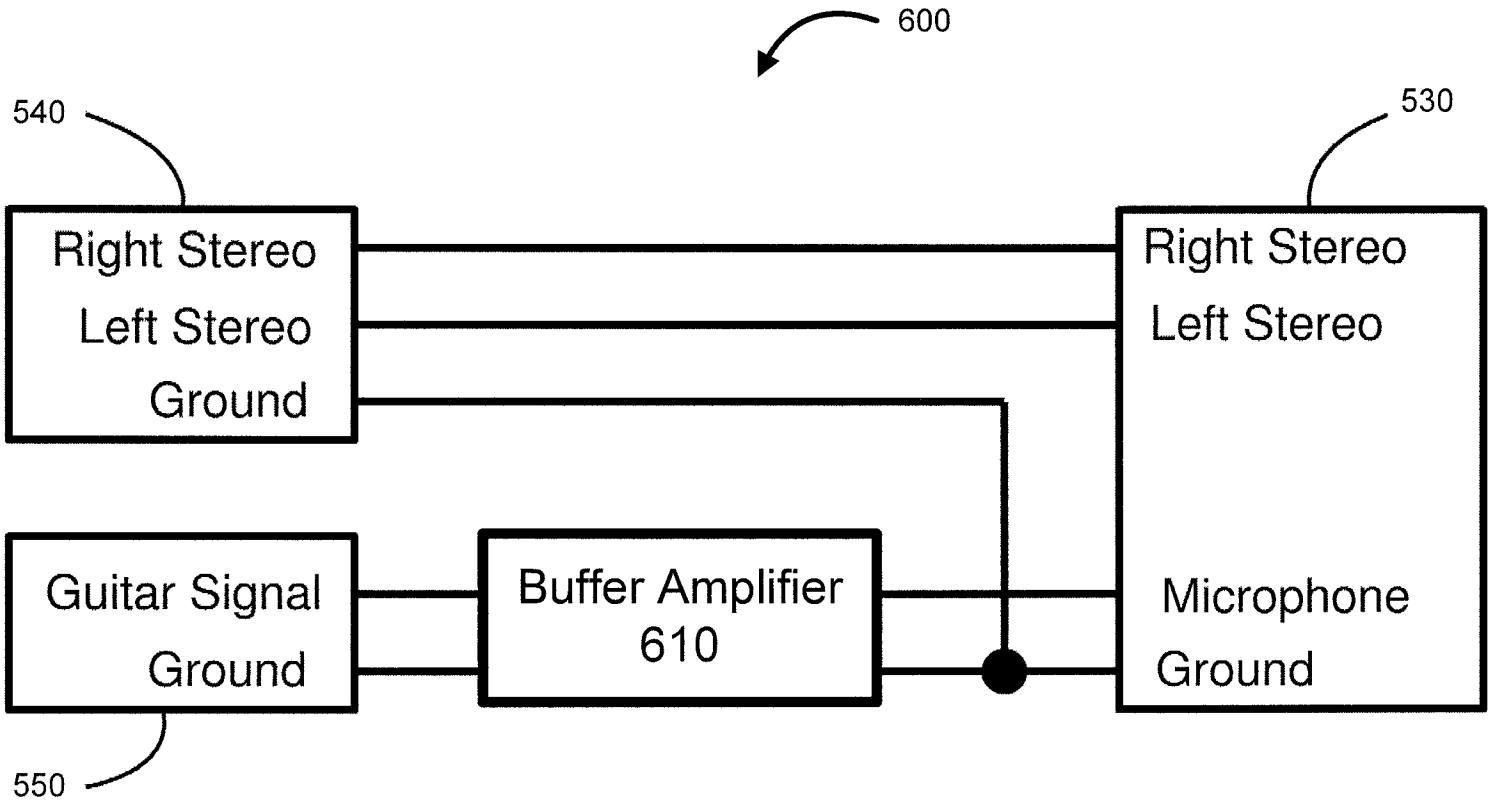
FIG. 6 illustrates a schematic wiring diagram for an exemplary embodiment of the audio coupling cable.

FIG. 6 illustrates an exemplary wiring diagram 600 for the audio coupling cable 520. The male stereo headphone plug 530 is plugged into the female stereo headphone jack 516 of the portable handheld computing device 510. The female stereo headphone jack 540 optionally receives stereo headphones. Male mono plug 550 connects to the electric guitar being played.

In addition to the mechanical connection problems of connecting a guitar to a handheld computing device, at least one electrical problem was encountered in the design of the system embodying the technology disclosed herein, the problem being relative to electrical impedance and loading. Electric guitars use two types of electronic circuits to transmit the guitar signal from the magnetic pickups to the guitar instrument output jack, namely, battery powered active electronics, and passive electronics without battery power. The passive electronics scheme is the more prevalent in current art guitars. With passive electronics, most guitar models have an output impedance on the order of 250 K ohms. Most audio circuits have an input impedance on the order of 10 K ohms. While guitars with active electronics generate an output with an impedance compatible to the host audio circuit, for guitar models with passive electronics, a direct connection to a handheld computing device with an input impedance on the order of 10 K ohms causes significant loading and loss of audio fidelity.

Referring now to FIG. 6, to deal with the loading issue caused by impedance imbalance, an exemplary circuitry 600 for the audio coupling cable 520 (FIG. 5) includes an optional buffer amplifier circuit 610. The buffer amplifier circuit 610 provides one example of circuitry that enables the audio coupling cable 520 to eliminate the loading issue, even when the audio coupling cable 520 is used with a guitar with passive electronics.

Figure 7:
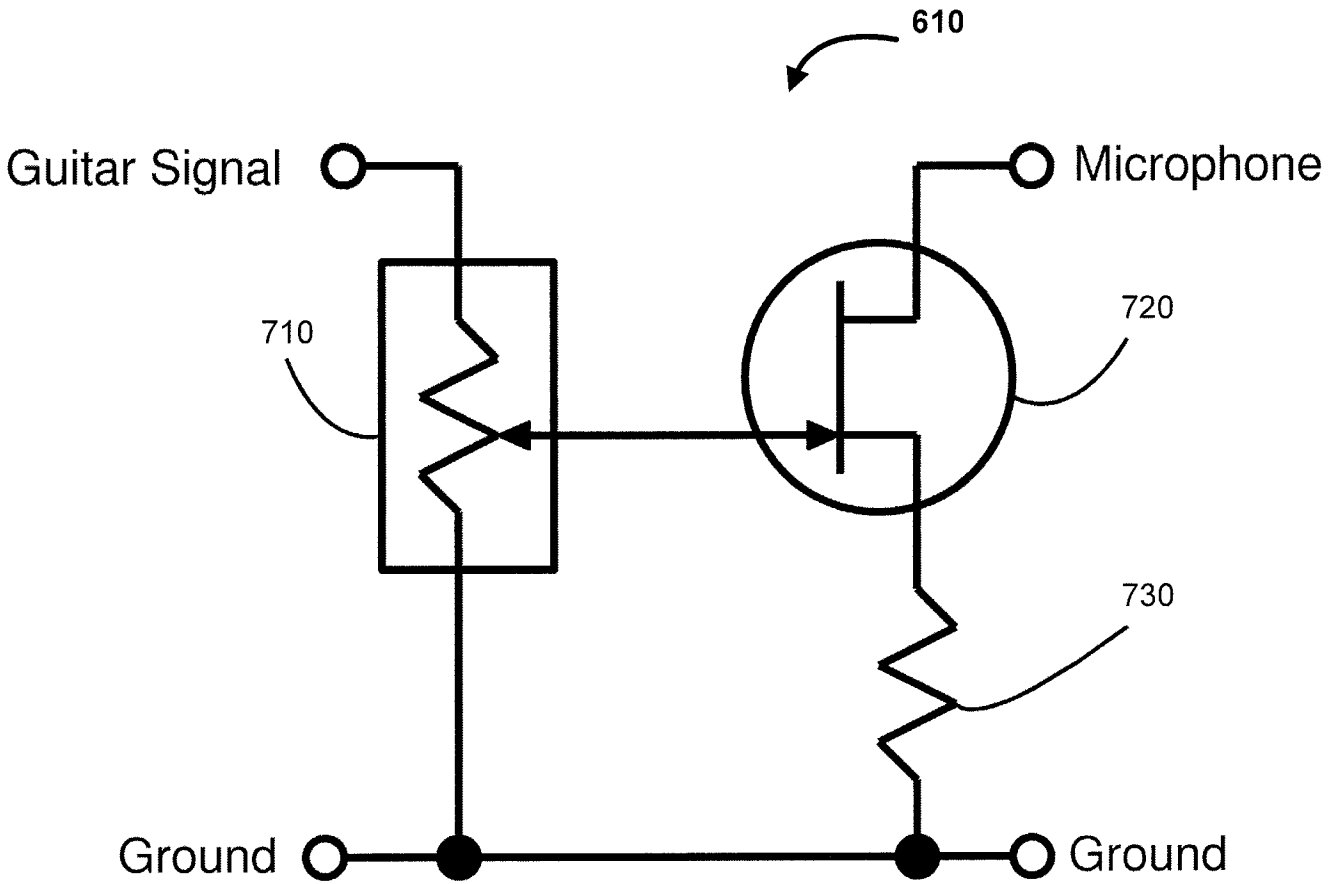
FIG. 7 is an electrical circuit wiring diagram for an exemplary embodiment of a buffer amplifier circuit.

While those skilled in the art will recognize that many variations can be implemented while maintaining the desired buffer amplifier effect, FIG. 7 shows a representative electrical circuit wiring diagram for the buffer amplifier circuit 610. A volume taper potentiometer 710 may be installed in line with the input guitar signal. The potentiometer 710 has an optimal value of 1 M ohm or higher, and prevents loading of the magnetic pickups of those guitar models with passive electronics. The potentiometer 710 also provides volume calibration tuned by the user to prevent clipping distortion which can occur at the analog to digital converter in the handheld computing device 510. This function is equivalent to the "Input Level" or "Trim" control commonly included on guitar amplifiers which use digital signal processing.

The buffer amplifier circuit 610 further comprises an n-channel junction gate field effect transistor 720, commonly known as a JFET, tied to the volume taper potentiometer 710. The JFET 720 provides high input impedance, low input noise voltage, and a simple means of direct current biasing. An additional benefit of the JFET 720 is that field effect transistors are generally thought to provide a more musical sound reproduction because their non-linear characteristics during saturation are similar to those of a vacuum tube.

The buffer amplifier circuit 610 is typically powered by utilizing the microphone battery voltage supplied by the handheld computing device 510. Source resistor 730 may be implemented to properly bias the JFET circuit 720 by establishing an appropriate level for the source bias current, and for gain configuration.

The buffer amplifier circuit 610 provides an excellent transition from a high input impedance to a low output impedance that is compatible with the host audio circuit. The buffer amplifier circuit 610 has a low noise level, provides a convenient means for volume calibration, and provides an efficient connection to the microphone signal in the handheld computing device 510. Still another function of the buffer amplifier circuit 610 is providing a recognizable input to the handheld computing device 510. A typical high impedance guitar output (250 K ohms) would draw so little current from the microphone connection that it would ordinarily not be detected. The reduced output impedance of the buffer amplifier circuit 610 allows the handheld computing device 510 to readily detect the presence of the guitar.

The buffer amplifier circuit 610 is generally necessary to avoid the loss of audio fidelity from loading effects. The buffer amplifier circuit 610 illustrated in FIG. 7 is very efficient, using a low bias current and a small number of circuit elements. Moreover, the buffer amplifier circuit 610 does not require an additional power source for operation, in that it uses the battery already supplied by the microphone signal of the handheld computing device 510.

A common variation for a buffer amplifier circuit is to replace the volume taper potentiometer 710 with a 1 M ohm resistor, and use the guitar's volume control as a trim adjustment. Unfortunately, this simplified design results in significant loss in audio fidelity, because the volume control on the guitar is known to interact with other passive elements in the guitar, causing a significant change in frequency response as the guitar's volume is adjusted. In addition, the simplified design is awkward for guitar players. If the guitar's volume control is used for volume calibration, then this control is not available to perform its normal function of changing the guitar's dynamics when the guitar is played during performances and practices.

Figure 8:
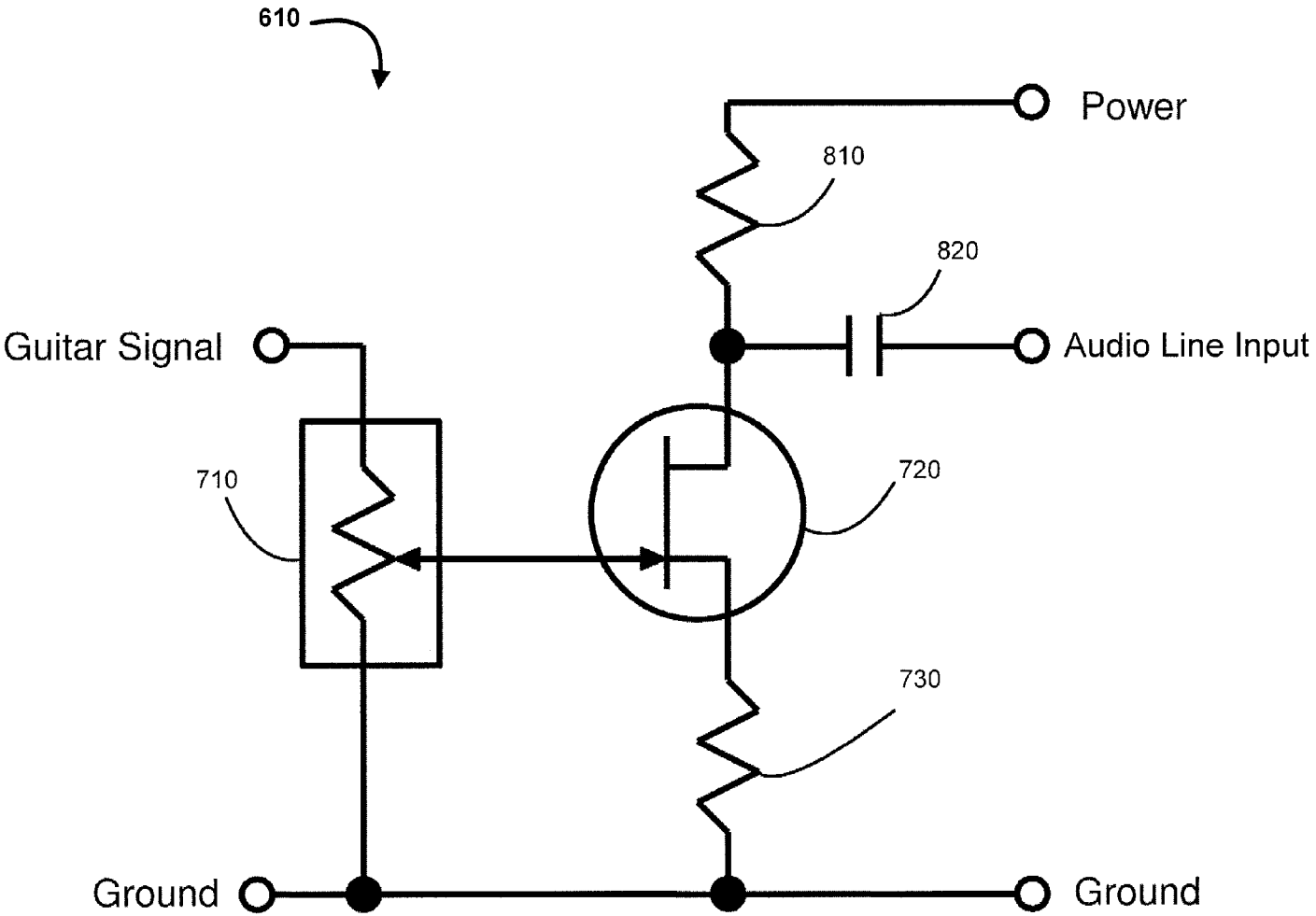
FIG. 8 shows an exemplary embodiment of the buffer amplifier circuit adapted to be used with a multifunction connecting cable.

FIG. 8 depicts an exemplary buffer amplifier circuit 610 configured to be utilized with a multifunction connection cable that includes an audio line input. Examples of handheld computing devices 510 that use this type of multifunction connection cable are the iPhone® and iPod Touch® that utilize a dock connector. It should be noted that if the multifunction cable uses a microphone input instead of an audio line input, the modifications to the buffer amplifier circuit 610 are not necessary.

Examples of additional elements that may be used to accommodate an audio line input include a drain resistor 810 and a DC voltage blocking capacitor 820. If implemented, the drain resistor 810 may be used, as may the source resistor 730, for biasing and gain configuration. The blocking capacitor 820 prevents DC voltage from the power signal biasing the JFET 720 from connecting to the audio line input signal.

Those skilled in the art will acknowledge that there are many workable implementations for the buffer amplifier circuit when an audio line input and a separate power signal are available. Some of those implementations would have desirable characteristics. For example, an operational amplifier integrated circuit could be used, and would provide power supply rejection and a larger voltage swing.

It may be desirable to provide a mechanism to reduce undesirable electrical coupling between the guitar signal received at male mono plug 550 and the stereo headphones output at second female stereo headphone jack 540. The input guitar signal processing step 420 of FIG. 4 may add significant signal gain between the receive input guitar signal step 410 and the output resultant signal step 430. This signal gain may produce undesirable audio feedback when electrical coupling is present between the guitar received at male mono plug 550 and the stereo headphones output at second female stereo headphone jack 540.

Figure 9:
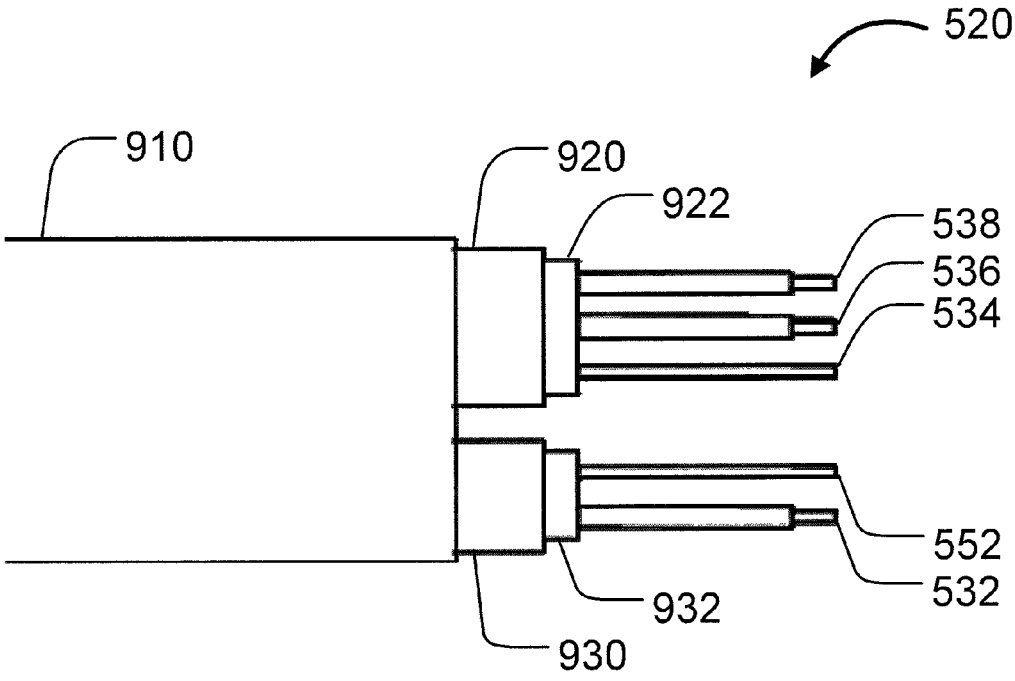
FIG. 9 shows a cut and wire stripped disassembly side view of the audio coupling cable.
Figure 10:
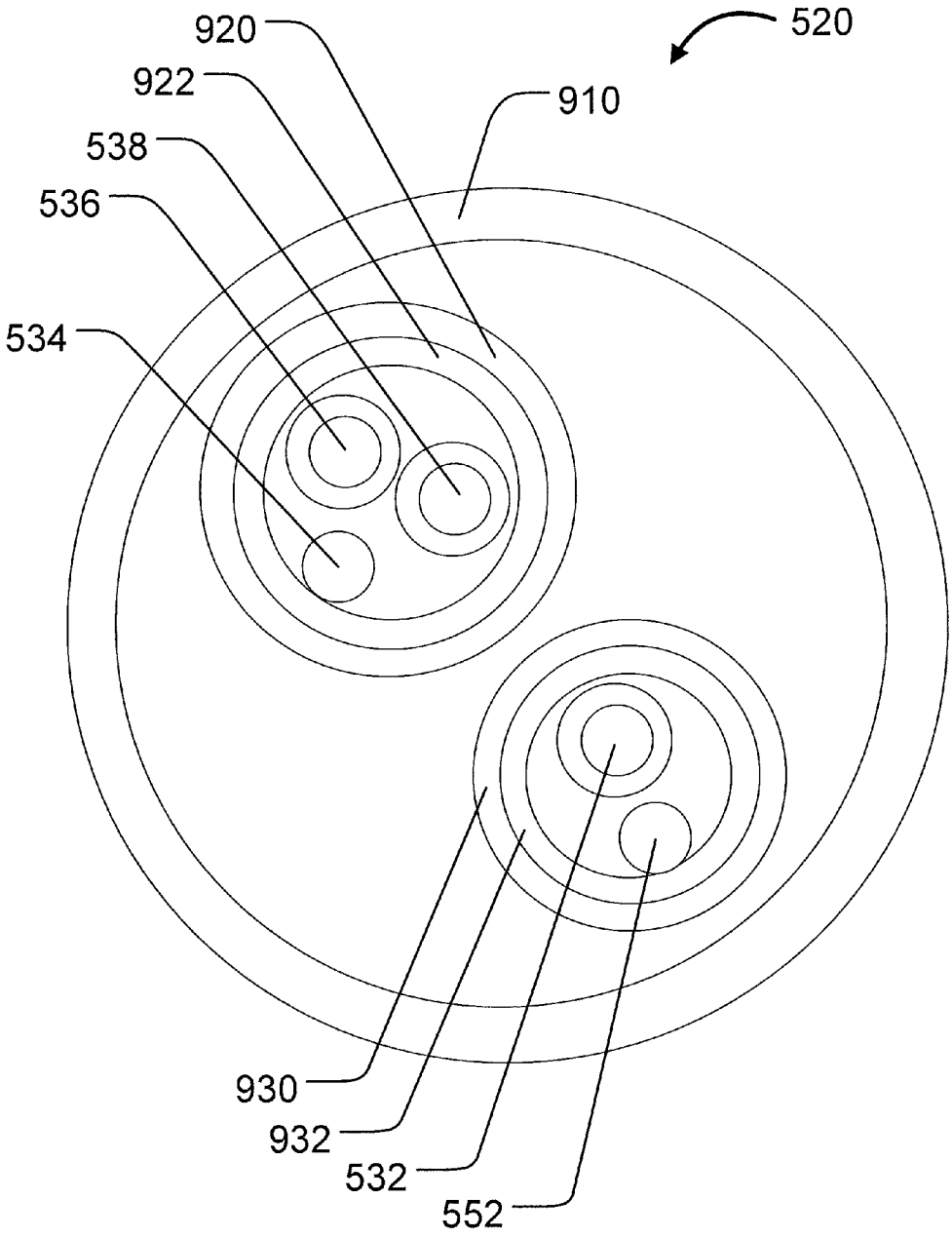
FIG. 10 shows a cross sectional view of the audio coupling cable.

To reduce or eliminate the undesirable electrical coupling, constructions for the audio coupling cable 520 as illustrated in FIGS. 9 and 10 may be employed. FIG. 9 shows a cut and wire stripped disassembly side view of the audio coupling cable 520. FIG. 10 shows a cut disassembly cross sectional view of the audio coupling cable 520.

The guitar signal, conducted by the wire carrying microphone signal 532, is routed with its own ground 552, a shield 932, and an insulator 930. The stereo output, including a left stereo output wire 538 and a right stereo output 536, is routed with a separate ground 534, a shield 922, and an insulator 920. The two wiring subassemblies, surrounded by insulators 920 and 930, are routed together with an external insulator 910. The external insulator 910 typically employs industry standard conformance materials for consumer audio wiring, such as UL AWM style VW-1 80 degrees C. 30V. The guitar ground signal 552 and output ground signal 534 may be connected at a location which produces the minimum undesirable electrical coupling, typically near stereo plug 530, or as close as possible to the portable handheld computing device 510.

In the configurations described above, the headphones output ground signal 534 is separated from the guitar input ground signal 552. Electrical shields 922 and 932 further reduce electrical coupling between the guitar signal 532 and the stereo headphones outputs 536 and 538.

While the present invention has been described in connection with a series of preferred embodiments, these descriptions are not intended to limit the scope of the invention to the particular forms set forth herein. It will be understood that the methods of the invention are not necessarily limited to the discrete steps or the order of the steps described. To the contrary, the present descriptions are intended to cover such alternatives, modifications, and equivalents as may be included within the spirit and scope of the invention as defined by the appended claims and otherwise appreciated by one of ordinary skill in the art.

What is claimed is:

1. An audio coupling device that couples an output of an electric musical instrument to a headphones jack of a portable handheld computing device, the audio coupling device comprising:

a first connector that receives an audio output signal of the electric musical instrument as audio input to the audio coupling device, the first connector comprising:

a first contact for an electric musical instrument signal, and a second contact for ground reference; and a second connector that outputs the audio output signal as an audio output from the audio coupling device to the audio input to the headphones jack of the portable handheld computing device, the second connector comprising:

a first contact for the electric musical instrument signal, a second contact for ground reference, a third contact for a right side stereo headphones output from the portable handheld computing device, and a fourth contact for a left side stereo headphones output from the portable handheld computing device.

2. The audio coupling device of claim 1, wherein the audio coupling device is configured to draw power from the portable handheld computing device.

3. The audio coupling device of claim 1, further comprising an input level control.

4. The audio coupling device of claim 1, wherein the audio coupling device further comprises a buffer amplifier circuit that receives an input signal with a high impedance and generates an output signal with a low impedance.

5. The audio coupling device of claim 4, wherein the audio coupling device is configured to draw power from the portable handheld computing device.

6. The audio coupling device of claim 4, wherein the buffer amplifier circuit is powered by a microphone battery voltage supplied by the portable handheld computing device.

7. The audio coupling device of claim 4, further comprising an input level control.

8. The audio coupling device of claim 1, wherein the audio coupling device further comprises a third connector, the third connector comprising:

a first contact for the right side stereo headphones output, a second contact for left side stereo headphones output, and a third contact for ground reference.

9. The audio coupling device of claim 8, wherein the audio coupling device is configured to draw power from the portable handheld computing device.

10. The audio coupling device of claim 8, further comprising an input level control.

11. The audio coupling device of claim 8, wherein at least a portion of cable wiring coupling the ground contact of the first connector to the ground contact of the second connector uses a different conductor from the cable wiring coupling the ground contact of the second connector to the ground contact of the third connector.

12. The audio coupling device of claim 8, wherein at least a portion of cable wiring coupling the first connector to the second connector is routed inside an electrical shield not containing the cable wiring coupling the second connector to the third connector.

13. The audio coupling device of claim 8, wherein the audio coupling device further comprises a buffer amplifier circuit that receives an input signal with a high impedance and generates an output signal with a low impedance.

14. The audio coupling device of claim 13, wherein the audio coupling device is configured to draw power from the portable handheld computing device.

15. The audio coupling device of claim 13, wherein the buffer amplifier circuit is powered by a microphone battery voltage supplied by the portable handheld computing device.

16. The audio coupling device of claim 13, further comprising an input level control.

17. The audio coupling device of claim 13, wherein at least a portion of cable wiring coupling the ground contact of the first connector to the ground contact of the second connector uses a different conductor from the cable wiring coupling the ground contact of the second connector to the third connector.

18. The audio coupling device of claim 13, wherein at least a portion of cable wiring coupling the first connector to the second connector is routed inside an electrical shield not containing the cable wiring coupling the second connector to the third connector.

19. The audio coupling device of claim 8, wherein at least a portion of cable wiring coupling the second connector to the third connector is routed inside an electrical shield not containing the cable wiring coupling the first connector to the second connector.

20. The audio coupling device of claim 13, wherein at least a portion of cable wiring coupling the second connector to the third connector is routed inside an electrical shield not containing the cable wiring coupling the first connector to the second connector.

* * * * *